US011650544B2

(12) United States Patent
Musy et al.

(10) Patent No.: US 11,650,544 B2
(45) Date of Patent: May 16, 2023

(54) MECHANICAL TIMEPIECE REGULATOR

(71) Applicant: CSEM Centre Suisse d'Electronique et de Microtechnique SA—Recherche et Developpement, Neuchatel (CH)

(72) Inventors: Gregory Musy, Le Mont-sur-Lausanne (CH); Olivier Laesser, La Chaux-de-Fonds (CH); François Barrot, Erlach (CH)

(73) Assignee: CSEM CENTRE SUISSE D'ELECTRONIQUE ET DE MICROTECHNIQUE SA - RECHERCHE ET DEVELOPPEMENT, Rue Jaquet Droz Neuchatel (CH)

( * ) Notice: Subject to any disclaimer, the term of this patent is extended or adjusted under 35 U.S.C. 154(b) by 225 days.

(21) Appl. No.: 16/751,212

(22) Filed: Jan. 24, 2020

(65) Prior Publication Data

US 2020/0241476 A1 Jul. 30, 2020

(30) Foreign Application Priority Data

Jan. 24, 2019 (CH) ..... 00078/19

(51) Int. Cl.
*G04B 17/04* (2006.01)
*G04B 17/06* (2006.01)
*G04B 17/32* (2006.01)

(52) U.S. Cl.
CPC ..... *G04B 17/063* (2013.01); *G04B 17/32* (2013.01)

(58) Field of Classification Search
CPC ..... G04B 17/32; G04B 17/06; G04B 17/04; G40B 17/063
See application file for complete search history.

(56) References Cited

U.S. PATENT DOCUMENTS

| | | | | |
|---|---|---|---|---|
| 8,540,418 | B2 * | 9/2013 | Richard | G04B 43/002 368/129 |
| 10,114,340 | B2 * | 10/2018 | Di Domenico | G04C 5/005 |
| 10,528,005 | B2 * | 1/2020 | Semon | G04B 1/225 |

FOREIGN PATENT DOCUMENTS

| | | |
|---|---|---|
| CH | 711571 | 3/2017 |
| CH | 712084 | 7/2017 |
| EP | 3059641 | 8/2016 |

* cited by examiner

*Primary Examiner* — Sean Kayes

(57) ABSTRACT

The mechanical timepiece regulator of the invention comprises a flexure bearing oscillator and a double detent escapement, the oscillator comprising a balance wheel (1) connected to an elastic suspension (2*a*, 2*b*) arranged to guide and apply a restoring force to the balance wheel (1) in a plane of oscillation. The escapement comprises an escape wheel (3) and an anchor (4) integrated into the balance wheel (1) and having two arms (5, 6) arranged to receive alternately the impulses of the escape wheel (3). The escapement furthermore comprises two detents (7, 8) alternately locking the escape wheel (3) between two impulses and interacting with the arms (5, 6) of the anchor to release the escape wheel (3) before each impulse, without direct interaction between the anchor and the escape wheel.

19 Claims, 7 Drawing Sheets

MECHANICAL TIMEPIECE REGULATOR

The present invention relates to an isochronous, self-starting mechanical timepiece regulator, the energy consumption of which is low.

One way of reducing the energy consumption of a mechanical timepiece regulator is using a so-called flexure bearing oscillator such as that described by CH709291. This type of oscillator has the distinctive feature of exhibiting both a high quality factor and a small amplitude. Both of these properties are also found in clock oscillators (pendulum), which is why the escapements associated with flexure bearing oscillators are often clock escapements such as recoil or deadbeat escapements. The main drawback with the majority of clock regulators is that they are not self-starting. Now, self-starting is an essential characteristic for a regulator intended to be used in a wristwatch. In fact, in this context, an external impact may cause a loss of amplitude of the balance wheel such that the regulator stops. If the regulator is not self-starting, it will then remain stuck.

Thus, for example, EP1736838 is known, which describes a mechanical oscillator and a grasshopper escapement. The escapement comprises two elastic pallets, each one of these pallets has one end connected to the balance wheel and one free end collaborating with an escapement wheel. The balance wheel is pushed by one of its pallets beyond the resting position of the balance wheel elastic suspension. It is therefore the balance wheel that pushes onto the second pallet so that the first pallet may disengage and unlocks the escape wheel. If the balance wheel does not have enough momentum to guarantee the unlocking of the escape wheel, the system will then remain blocked. This principle cannot, therefore, be self-starting.

Deadbeat escapement systems are also known, the impulse of which is transmitted either directly to a flexure bearing oscillator such as EP3182213 and WO2017068538 or indirectly via an elastic leaf spring such as WO2018100122. The main disadvantage of a deadbeat escapement is the high energy consumption of the system due to the friction between the anchor and the escape wheel. Furthermore, the isochronism of this type of escapement is difficult to tune.

Another type of escapement already associated with a flexure bearing oscillator is the detent escapement such as EP3059641. With this type of escapement, the impulse can be given to the oscillator one out of two semi-periods of oscillation and this principle, just as the grasshopper escapement, cannot be self-starting.

The aim of the present invention is to propose an isochronous, self-starting mechanical timepiece regulator, the energy consumption of which is low.

The mechanical timepiece regulator of the invention comprises a flexure bearing oscillator and a double detent escapement, the oscillator comprising a balance wheel connected to an elastic suspension arranged to guide and apply a restoring force to the balance wheel in a plane of oscillation. The escapement comprises an escape wheel and an anchor integrated into the balance wheel and comprising two arms arranged to receive alternately the impulses of the escape wheel. The escapement furthermore comprises two detents alternately blocking the escape wheel between two impulses and interacting with the arms of the anchor to release the escape wheel before each impulse, without direct interaction between the anchor and the escape wheel. Then the escape wheel transmits its impulse directly to the arms of the anchor.

The main advantage of the invention in relation to a traditional timepiece regulator composed of a balance wheel-hairspring type oscillator and a Swiss anchor escapement is that its power consumption is much lower, typically at least three times lower. Due to this fact, the first advantage resulting from this low power consumption is that the power reserve of the watch will be larger. This implies that the operating time of the watch before it stops will be three times longer. The second advantage associated with this low energy consumption: the coil mainspring (source of energy of the watch) will take three times longer to unload; its torque will therefore vary less over a given lapse of time which means, for a given isochronism of the regulator, that the variation of rate of the watch over this lapse of time will also be lower. The characteristics of the system allowing this energy consumption to be minimised will be described later.

In one embodiment, each detent comprises a leaf spring, one end of which is fixed and one end of which is free, these free ends interacting on the one hand with an anchor arm and on the other hand with the escape wheel. These detents are therefore clearly differentiated from classical detents such as described in EP3059641. In fact, a classical detent comprises a rigid structure equipped with a pivot, a rigid stop and a leaf spring.

A leaf spring is understood to be any prismatic beam (typically of rectangular cross-section) the thickness of which is at least 10 times less than the length and at least 2 times less than the width. The section may change size along the leaf spring and the trajectory along the length of this leaf spring may be straight or curved.

According to this embodiment, the free end of each detent comprises a locking plane interacting with the teeth of the escape wheel to lock it during the resting phase of the escapement while allowing the balance wheel to oscillate without coming into contact with the escape wheel.

Still according to the same embodiment, the free end of each detent comprises an unlocking plane interacting with the anchor arms to release the escape wheel before each impulse.

Preferably, the ends of the anchor arms comprise impulse planes interacting with the tip of each tooth of the escape wheel in such a way that energy is transferred from the escape wheel to the balance wheel. At the end of the impulse phase, the tip of the anchor impulse plane becomes the impulse beak and is pushed by the impulse plane of one of the escape wheel teeth. This constitutes an advantageous configuration, but it is clear that the impulse beak could be located only on the escape wheel and that the impulse plane could be located only on the anchor or vice versa.

According to this preferential embodiment, the locking planes of the detents are arranged in relation to the anchor arms in such a way that at the end of the unlocking (accomplished by the anchor) of one or the other of the detents, the tooth of the escape wheel in contact with the locking plane of said detent transits directly onto the impulse plane of the anchor arms without dropping. A drop is a free rotation (without any contact with the anchor) of the escape wheel, which is often necessary as a transition between two escapement phases to ensure that the system cannot be blocked but also constitutes a significant loss of energy for every escapement. In this embodiment, a drop is not required between the unlocking and the impulse because the escape wheel only comprises a single set of toothing on a single level. The locking planes of the detents, the impulse planes of the anchor and the toothing of the escape wheel are therefore located on the same working plane. Nevertheless, it may be useful to add a drop between the unlocking phase and the impulse phase to avoid the anchor arms generating a recoil of the escape wheel before the unlocking phase due to positioning errors when assembling the parts constituting the escapement. It is clear that the global operation of the system would remain the same but that the energy consumption could be affected. Furthermore, the fact that the escape wheel is made of a single level and a single toothing constitutes a major design advantage because this also contributes to reducing the inertia of the escape wheel which is a determining parameter for the energy consumption of the regulator. In fact, the losses of inertial energy are due to the fact that it is necessary, on each impulse, to accelerate significantly the escape wheel so that it catches up the balance wheel and transmits its torque to it, this kinetic energy is then lost when the escape wheel collides with the locking plane of the detents. This loss of inertial energy may become considerably high compared to other types of losses when using a high frequency oscillator such as a flexure bearing oscillator. Therefore, it is crucial to minimise the inertia of the escape wheel for an escapement operating with this particular type of oscillator.

According to this embodiment, at each period of the oscillator, each of the two impulse planes receives an impulse from the escape wheel.

According to this preferential embodiment, the impulse planes of the anchor arms have a curved shape so that when the escape wheel transfers its energy to the balance wheel, the escape wheel is essentially moving with a uniform acceleration. The purpose of the impulse plane shape will be described in more detail later.

In one embodiment, the regulator comprises a fixed base comprising two rigid stops each corresponding respectively to one of the detents, these two rigid stops being arranged to give a pre-loaded torque from its respective detent against the corresponding stop.

According to this embodiment, at least one of the detents comprises an end connected rigidly to an arm co-operating with a tuning table, this end being connected opposite to the said end of the flexible detent; the position of this tuning table can be modified in relation to the fixed base in order to change the orientation of the flexible detent in relation to its rigid stop, which allows the pre-loading torque of the flexible detent resting against its rigid stop to be changed.

In another embodiment, at least one of the detents interacts with a stiffening mechanism implemented to change the active length of the leaf spring of said detent.

In an embodiment, the anchor comprises a beak interacting with a tooth of the escape wheel in such a way that this tooth of the escape wheel acts as a locking plane in the event that one of the detents does not manage to block the escape wheel.

The elastic suspension of the oscillator preferably comprises at least two leaf springs forming a flexure bearing.

The balance wheel, the anchor and the detents are typically made of silicon and designed to be compatible with DRIE technologies and the inertial body of the balance wheel is obtained by assembling a ring of dense material and a ring of silicon. The silicon may be replaced by another material such as silica glass which would be shaped by a laser, typically a femto-second one, and may be followed by chemical etching.

The invention also relates to a timepiece movement or a wristwatch comprising a regulator according to the present invention.

The characteristics of the invention will become more apparent when reading the description of several embodiments solely given as examples, in no way limiting, and which refer to the schematic figures in which.

Figure 1:
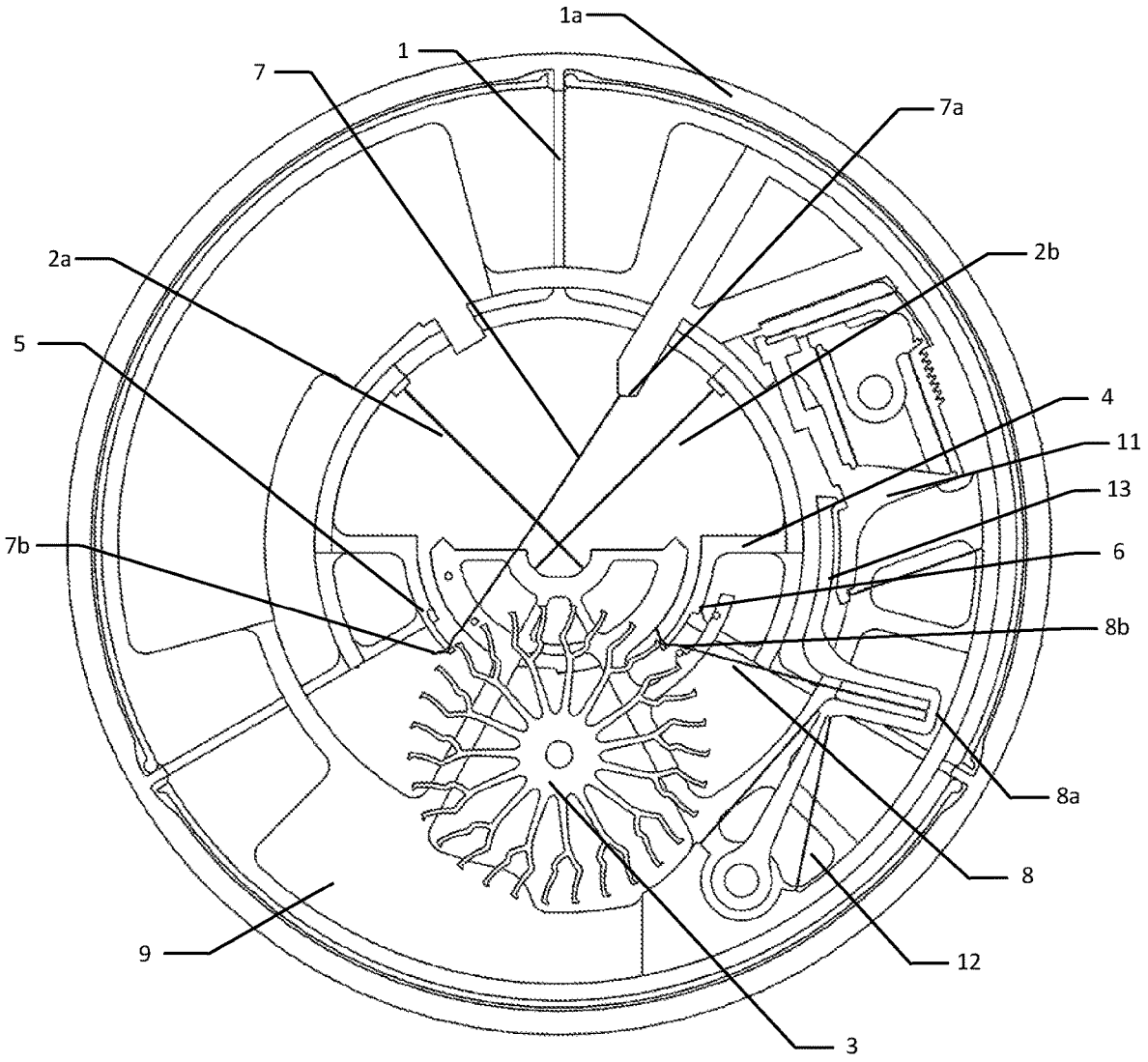
FIG. 1 illustrates a front view of a regulator comprising a flexure bearing oscillator and a double detent escapement.
Figure 2:
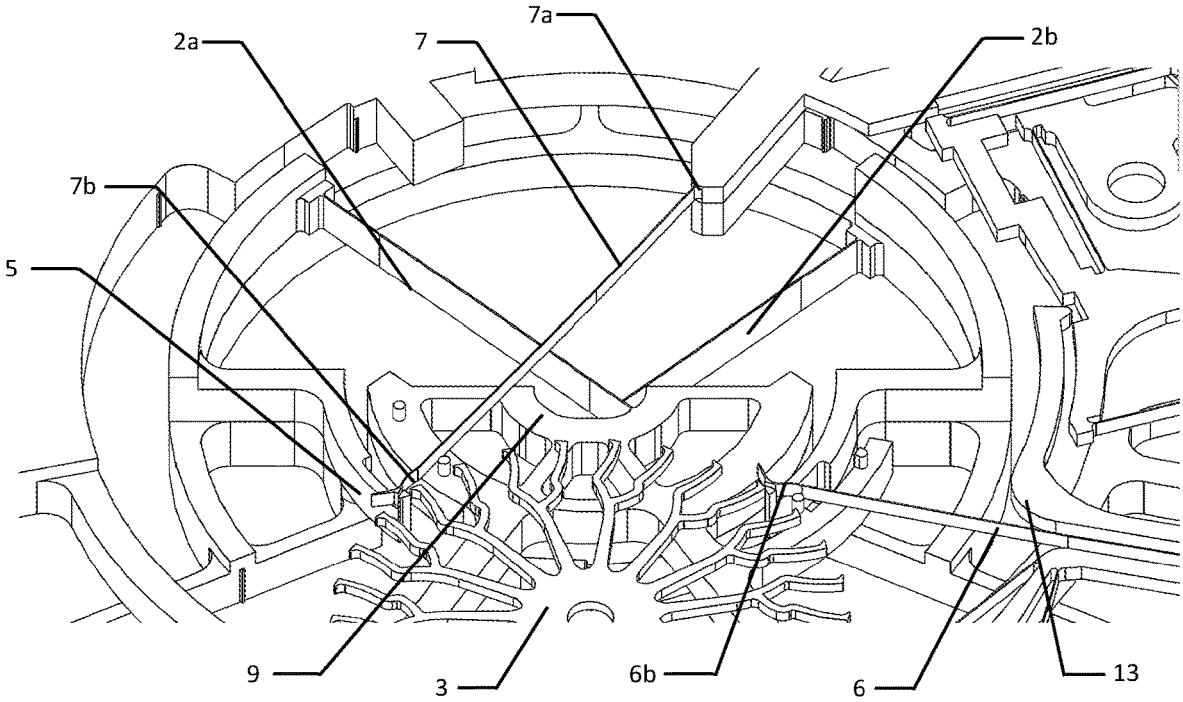
FIG. 2 illustrates an oblique view of the same regulator.

As illustrated in FIG. 1 and FIG. 2, the mechanical timepiece regulator comprises a flexure bearing oscillator and a double detent escapement, the oscillator comprising a balance wheel 1 connected kinematically to flexure blades 2*a*, 2*b* arranged to exert an elastic restoring force on the balance wheel 1 and guide it in a plane of oscillations. The escapement comprises an escape wheel 3 and an anchor 4 integrated into the balance wheel 1 and comprising two arms 5, 6 arranged to receive alternately the impulses of the escape wheel 3. The escapement furthermore comprises two detents 7, 8 blocking alternately the escape wheel 3 between two impulses and interacting with the arms 5, 6 of the anchor to release the escape wheel 3 before each impulse, without direct interaction between the anchor and the escape wheel.

The flexure bearing oscillator comprises an inertial body 1*a* connected to the flexure blades 2*a*, 2*b* providing both the bearing function of the inertial body 1*a* in the desired trajectory and the elastic restoring force Each detent 7, 8 comprises a leaf spring one end of which is fixed 7*a*, 8*a* and one end of which is free 7*b*, 8*b*, this free end interacting both with an anchor arm 5, 6 and with the escape wheel 3.

The isochronism error of the suspension 2*a*, 2*b* of the oscillator is corrected by the detents 7, 8. A single detent 7, 8 rests on the balance wheel 1 during the supplementary arc (arc described by a balance wheel outside the functions of the escapement) and the two detents 7, 8 are in contact with the balance wheel 1 during the unlocking phase of the escape wheel and the impulse. As the detents 7, 8 are flexible, the stiffness of the regulator varies during the oscillation. The detents 7, 8 therefore tend to decrease the average stiffness of the oscillator at high amplitudes. This compensates for the fact that the flexible suspension of the oscillator tends to be stiffer on average at high amplitudes.

The free end of each detent 7*b*, 8*b* comprises a locking plane 7*c*, 8*c* (see FIGS. 2, 3 and 4) interacting with the teeth of the escape wheel 3 to block it during the locking phase of the escapement while allowing the balance wheel 1 to oscillate without coming into contact with the escape wheel 3.

The free end of each detent 7, 8 comprises an unlocking plane interacting with the anchor arms 5, 6 to release the escape wheel 3 before each impulse.

Figure 3:
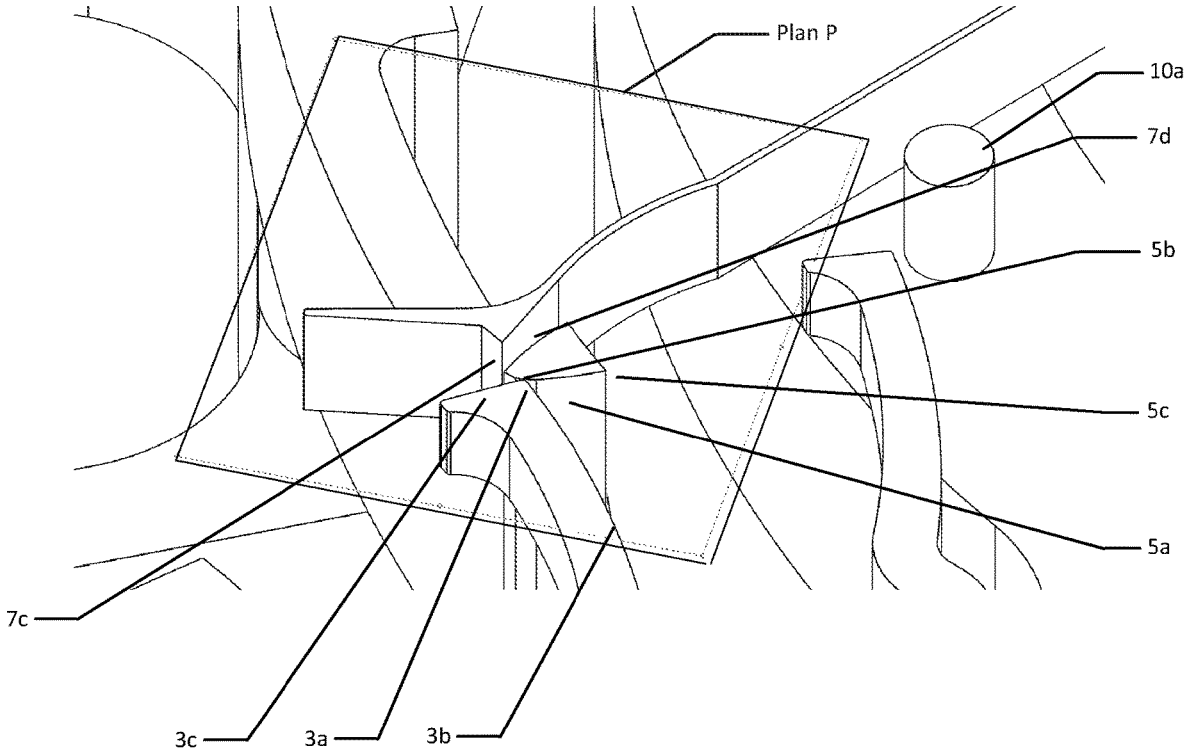
FIG. 3 illustrates an oblique view of the entry functions of the escapement.
Figure 4:
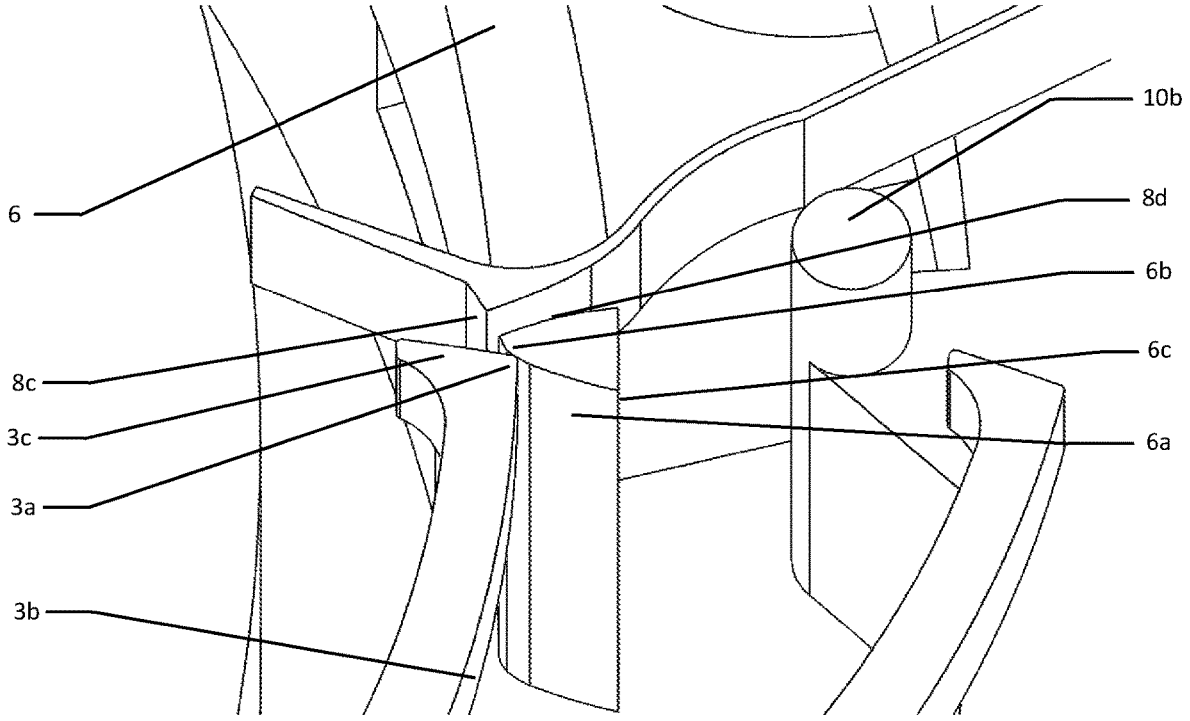
FIG. 4 illustrates an oblique view of the exit functions of the escapement.
Figure 5:
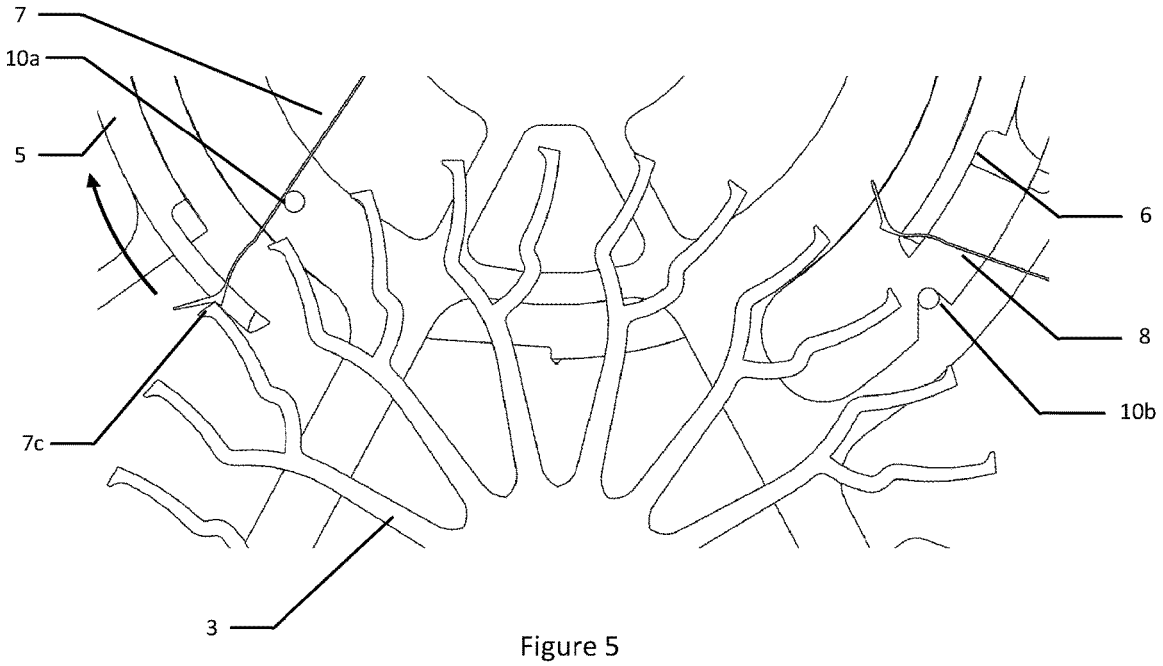
FIG. 5 illustrates a top view of the escapement in a locking position.
Figure 6:
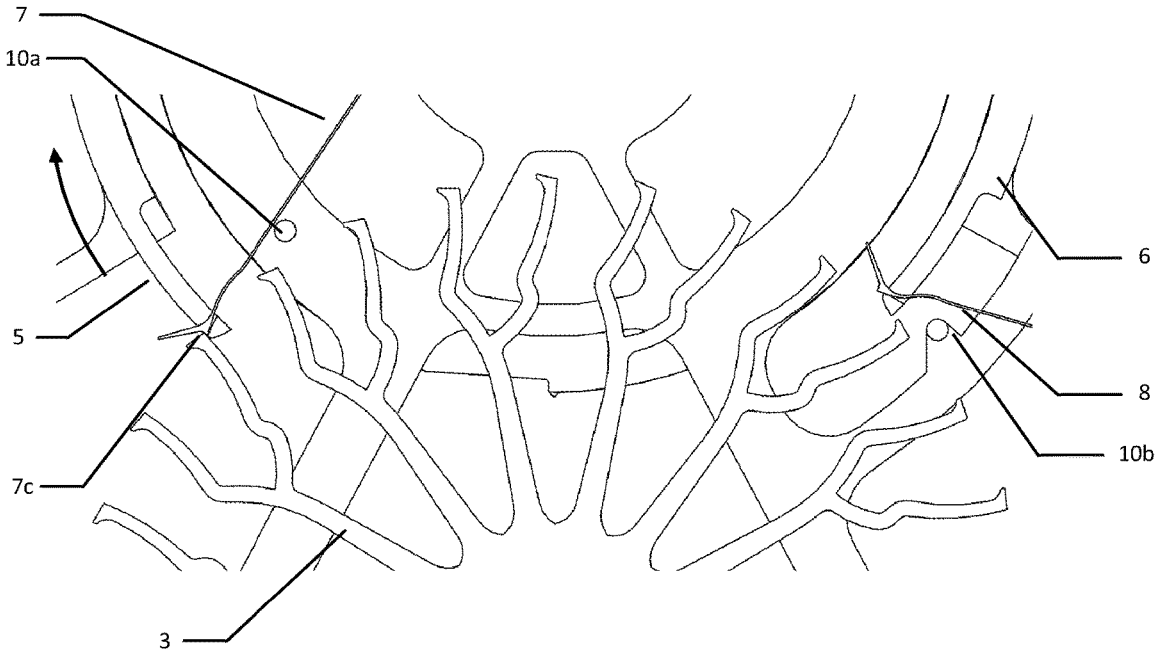
FIG. 6 illustrates a top view of the escapement in an unlocking position.

As illustrated in FIGS. 3 and 4, the ends of the anchor arms 5, 6 comprise impulse planes 5*a*, 6*a* interacting with the teeth of the escape wheel 3 in such a way that energy is transferred from the escape wheel 3 to the balance wheel 1. At the end of the first part of the impulse phase, the tip of the impulse plane 5*c*, 6*c* becomes the impulse beak and is pushed by the impulse plane of the tooth of the escape wheel 3*c*.

The impulse planes 5*a*, 6*a* are preferably arranged contiguous with the locking planes of detents 7*c*, 8*c* to prevent a drop phase between the unlocking and impulse phases; otherwise, this drop phase would cause a loss of energy, therefore a lower efficiency of the escapement and therefore a lower amplitude of the balance wheel 1. This effect can be obtained by the fact that the escape wheel 3 only comprises a single toothing on a single stage and that the escape wheel 3 is located on the same plane P of operation as the locking planes 7*c*, 8*c* of the detents and the impulse planes of the anchor 5*a*, 6*a*.

At each oscillation period of the oscillator, each of the two impulse planes 5*a*, 6*a* of the anchor arms receives an impulse from the escape wheel 3. These impulse planes 5*a*, 6*a* have a curved shape so that, when the escape wheel 3 transfers its energy to the balance wheel 1, the escape wheel 3 is essentially moving with a uniform acceleration. In other words, the impulse planes 5*a*, 6*a* are said to be "lightly touching", in other words they guarantee at least a light touch of the tip of the escape wheel 3*a* on one of the impulse planes 5*a*, 6*a* during the impulse phase. This ensures continuous transfer of energy from the escape wheel 3 to the balance wheel 1. This characteristic is important for escapements interacting with a flexure bearing oscillator as the latter have the particular feature of having a high frequency, typically from 10 to 20 Hz, and a low amplitude, typically from 5 to 20 degrees. In this context, the impulse phase is brief and the balance wheel 1, for a given amplitude, sways fast. Furthermore, before the impulse the escape wheel 3 is stopped while the balance wheel 1 is close to its maximum velocity. Therefore, due to the "lightly-touching" impulse plane, the escape wheel 3 manages, in any case, to catch up with the balance wheel 1 and to transfer its energy to it whatever the amplitude of the balance wheel 1 (from zero to its nominal amplitude). Moreover, the "lightly-touching" profile of the impulse plane involves a variable gear ratio (ratio of rotation or rotational speed between two bodies) between the escape wheel 3 and the anchor 4. The torque applied to the anchor 4 is thus increased during the impulse so as to compensate for the increase of the elastic restoring torque of the elastic suspension 2*a*, 2*b* of the oscillator (like in every common spring the elastic torque increases when we stretch the spring). So even when the oscillator is stopped, the torque of the escape wheel 3 is sufficient to finish the impulse, which allows the system to be self-starting. The regulator comprises a fixed base 9 comprising two rigid stops 10*a*, 10*b* each respectively interacting with one of the detents 7, 8; each of these rigid stops is arranged to apply a pre-loading torque onto its respective detent.

Figure 7:
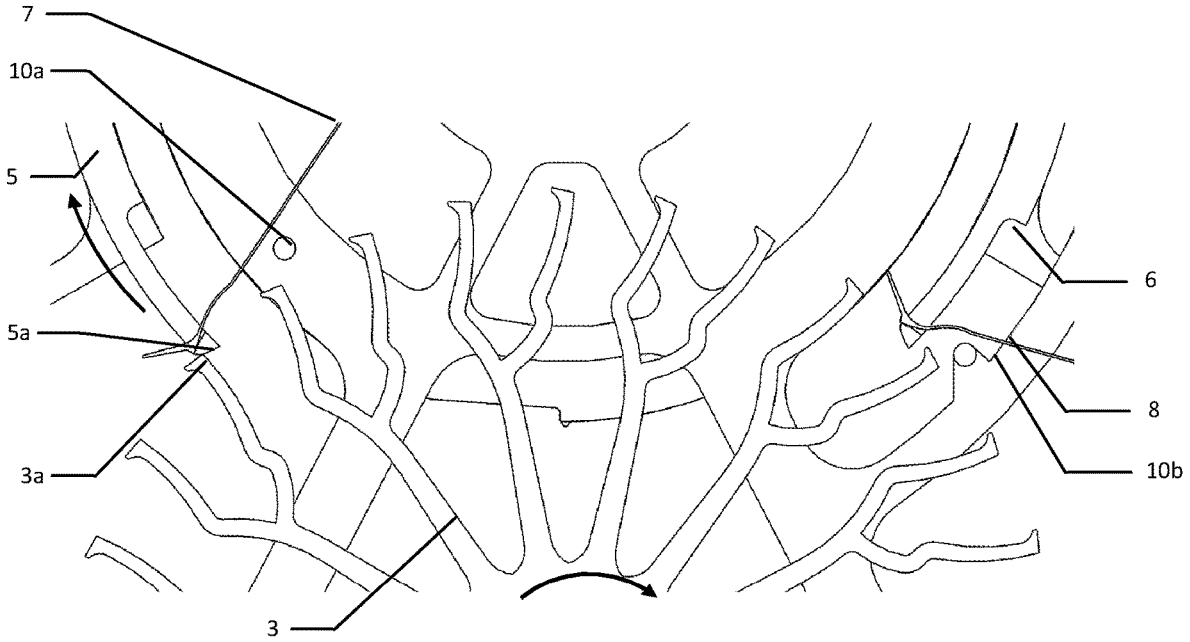
FIG. 7 illustrates a top view of the escapement in an impulse position.
Figure 8:
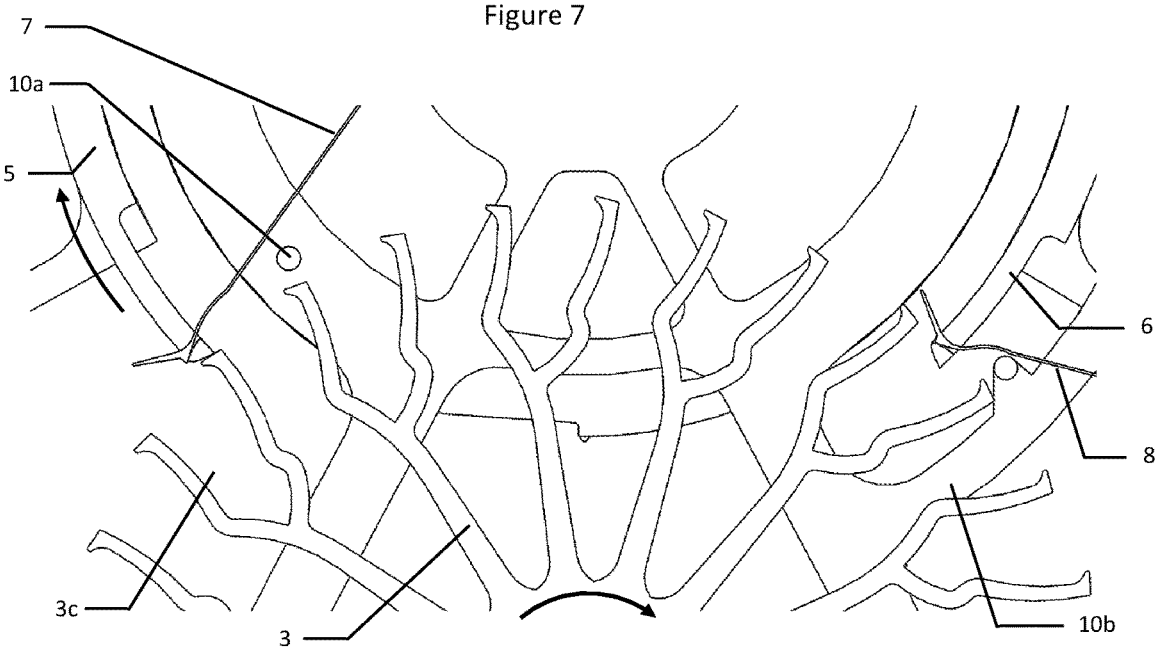
FIG. 8 illustrates a top view of the escapement at the end of an impulse phase.
Figure 9:
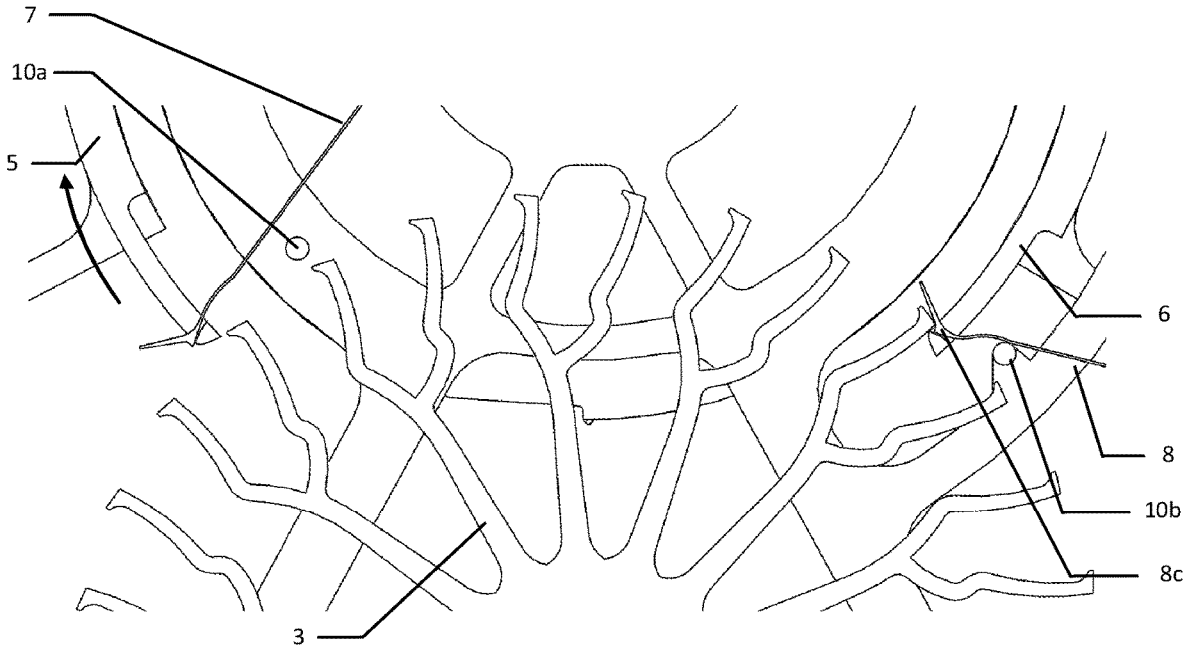
FIG. 9 illustrates a top view of the escapement in a locking position.

When the detents 7, 8 are not in contact with the balance wheel 1, they rest with a pre-loading torque on the rigid stops 10*a*, 10*b*. The pre-loading torque of at least one of the detents is adjustable and allows the isochronism error of the timepiece regulator to be tuned. Furthermore, the rigid stops 10*a*, 10*b* (see FIG. 7) and the pre-loading torque allow the detents 7, 8 to be precisely positioned during the locking phase of the escape wheel and to secure their positioning in case of external impacts.

In the example illustrated by FIGS. 1 to 9, the orientation of the detent 8 is adjustable and allows the isochronism of the timepiece regulator to be adjusted. The detent 8 comprises one end 8*a* connected rigidly to an arm 13 interacting with a tuning table 11. This connected end 8*a* is on the opposite end of the free end 8*b* of the flexible detent 8; the position of this tuning table 11 can be modified in relation to the fixed base 9 in order to change the orientation of the flexible detent 8 in relation to its rigid stop 10*b*, thus changing the pre-loading torque of the flexible detent 8 resting against the corresponding rigid stop 10*b*. It is clear that this mechanism may also be used to make a fine tuning of the frequency of the system.

Figure 10:
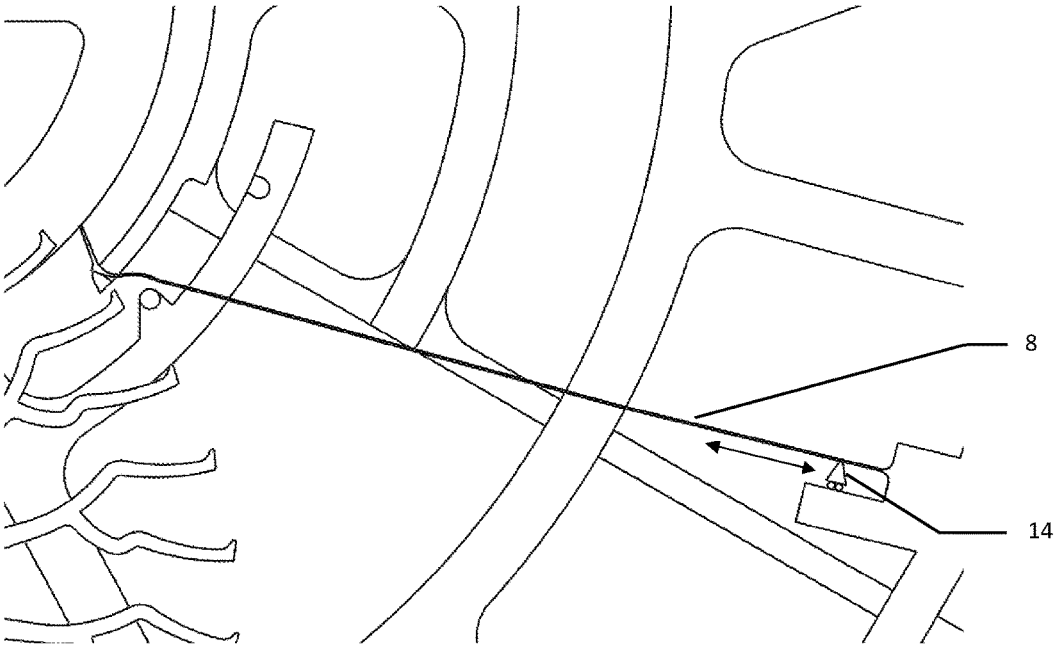
FIG. 10 illustrates an alternative way of tuning the isochronism of the system.

Alternatively and illustrated in FIG. 10, still in order to adjust the isochronism or frequency of the system, the detent 8 may interact with a stiffening mechanism 14 arranged to modify the active length of the leaf spring of the detent.

Coming back to the embodiment of FIGS. 1 to 9, each arm of the anchor 4 comprises a tip 5*b*, 6*b* interacting with a tooth of the escape wheel 3 in such a way that part 3*b* of this tooth of the escape wheel 3 acts as a locking plane in lieu of the detents 7, 8 in the event that, for example, following an impact, one of the latter cannot manage to block the escape wheel 3.

Furthermore, it is also possible to add locking planes onto the balance wheel 1. These locking planes, for example, following an impact, would prevent one or the other of the detents from pivoting too much and release the escape wheel. These locking planes, therefore, would be involved only when the escape wheel 3 is at rest with said detent 7, 8.

FIGS. 5 to 9 illustrate the sequential operation of the escapement with double detents during the semi-period of oscillation when the balance wheel 1 oscillates clockwise. The main phases of the escapement are the following:

- The escape wheel 3 starts by being at rest on the entry detent 7*c* (FIG. 5), the entry detent 7 is resting on its stop 10*a* and the exit detent 8 is resting on the exit arm 6 of the anchor.
- The pivoting of the balance wheel 1 causes the unlocking of the entry detent 7 by the entry arm of the anchor 5, which releases the escape wheel 3 (FIG. 6), the entry detent 7 is then no longer in contact with its stop 10*a* and is carried along by the entry arm of the anchor 5.
- The escape wheel 3 is now released and pivots clockwise (FIG. 7), the tip 3*a* of one of the teeth of the escape wheel is in contact with the lightly touching entry impulse plane 5*a* and pushes the anchor 4.
- The escape wheel 3 then continues its impulse (FIG. 8), the impulse plane 3*c* of the tooth pushing the entry arm of the anchor 5.
- At the end of the impulse, the opposite anchor arm leaves the detent on its stop.
- The entry impulse is completed (FIG. 9), the escape wheel 3 drops clockwise and is blocked by the locking plane 8*c* of the exit detent. The exit detent 8 is resting against its stop 10*b* and the entry detent 7 is carried along by the entry arm of the anchor 5.

The following semi-period of oscillation then continues in an equivalent way with the rotation of the balance wheel 1 anti-clockwise followed by the unlocking, the impulse and the drop phases on the exit functions of the escapement.

In the example illustrated, the elastic suspension 2*a*, 2*b* of the flexure bearing oscillator comprises two leaf springs, but it may comprise more and the topology chosen (here of type Wittrick according to EP2911012) to represent this oscillator is given solely by way of example and is in no way limiting.

Owing to the regulator of the present invention, the energy consumption may be very low, less than 0.3 μW (typically 0.25 μW). Such a low power consumption is mainly associated with:

the low amplitude of the balance wheel required to be isochronous and non-sensitive to gravity, typically between 8 and 16 degrees, the absence of friction in the flexible pivot of the balance wheel, the fact that the impulse is transferred directly from the escape wheel to the balance wheel which suppresses any loss of energy associated with an intermediate motion between the escape and balance wheels, the fact that the detents allow the friction that may occur to be limited during any locking or recoil phase, the absence of drop between the unlocking of the escape wheel and the impulse, and the minimisation of the escape wheel inertia.

Another advantage of the present regulator is that the isochronism error of the double detent escapement naturally compensates for the isochronism error of the flexible pivot of the oscillator. This effect is obtained due to the fact that, unlike classical detent escapements, there is always at least one detent in contact with the balance wheel. Moreover, as explained previously, the isochronism error of the escapement of the present invention can be tuned, which allows to adapt to the isochronism of the oscillator that may vary from one oscillator to another due to imprecisions in the manufacturing and assembly of parts.

Finally, the double detent escapement of the present regulator is self-starting because on the one hand there is an impulse every semi-period of oscillation unlike classical detent escapements and, on the other hand, no specific momentum is needed from the balance wheel to enable the unlocking of the escape wheel. Furthermore, the profile of the lightly touching impulse planes implies a variable gear ratio that increases the torque applied to the anchor by the escape wheel when the impulse finishes, which makes self-starting easier.

(1) Balance wheel
(1*a*) Inertial body
(2*a*, 2*b*) Elastic suspension
(3) Escape wheel
(3*a*) Tip of a tooth of the escape wheel
(3*b*) Safety locking plane of a tooth of the escape wheel
(3*c*) Impulse plane of a tooth of the escape wheel
(4) Anchor
(5) Entry arm of the anchor
(5*a*) Impulse plane of the entry arm of the anchor
(5*b*) Safety tip of the entry arm of the anchor
(5*c*) Impulse beak of the entry arm of the anchor
(6) Exit arm of the anchor
(6*a*) Impulse plane of the exit arm of the anchor
(6*b*) Safety tip of the exit arm of the anchor
(6*c*) Impulse beak of the exit arm of the anchor
(7) Entry detent
(7*a*) Fixed end of the entry detent
(7*b*) Free end of the entry detent
(7*c*) Locking plane of the entry detent
(7*d*) Unlocking plane of the entry detent
(8) Exit detent
(8*a*) Fixed end of the exit detent
(8*b*) Free end of the exit detent
(8*c*) Locking plane of the exit detent
(8*d*) Unlocking plane of the exit detent
(9) Fixed base
(10*a*) Stop of the entry detent
(10*b*) Stop of the exit detent
(11) Tuning table
(12) Flexure bearing of the pre-loading tuning arm
(13) Tuning arm
(14) Stiffening means

The invention claimed is:

1. Mechanical timepiece regulator comprising a flexure bearing oscillator and a double detent escapement, the oscillator comprising a balance wheel (1) connected kinematically to an elastic suspension (2*a*, 2*b*) arranged to guide and apply a restoring force to the balance wheel (1) in a plane of oscillation, the escapement comprising:

an escape wheel (3), an anchor (4) integrated into the balance wheel (1) and having two arms (5, 6) arranged to receive alternately the impulses of the escape wheel (3), characterised in that said escapement furthermore comprises two detents (7, 8) alternately blocking the escape wheel (3) between two impulses and interacting with the arms (5, 6) of the anchor to release the escape wheel (3) before each impulse, without direct interaction between the anchor and the escape wheel.

2. Regulator according to claim 1, characterised in that each detent (7, 8) comprises a leaf spring one end of which is fixed (7*a*, 8*a*) and one end of which is free (7*b*, 8*b*), these free ends interacting both with an anchor arm (5, 6) and with the escape wheel (3).

3. Regulator according to claim 2, characterised in that the free end of each detent (7*b*, 8*b*) comprises a locking plane (7*c*, 8*c*) interacting with the teeth of the escape wheel (3) to lock it during the locking phase of the escapement while allowing the balance wheel (1) to oscillate without coming into contact with the escape wheel (3).

4. Regulator according to claim 2, characterised in that the free end of each detent (7, 8) comprises an unlocking plane 7*d*, 8*d* interacting with the anchor arms (5, 6) to release the escape wheel (3) before each impulse.

5. Regulator according to claim 1, characterised in that the ends of the anchor arms (5, 6) comprise impulse planes (5*a*, 6*a*) interacting with the teeth of the escape wheel (3) in such a way that energy is transferred from the escape wheel (3) to the balance wheel (1).

6. Regulator according to claim 5, characterised in that it comprises locking planes of detents (7*c*, 8*c*) arranged in relation to the anchor arms (5, 6) in such a way that at the end of the unlocking of one or the other of the detents, the tooth of the escape wheel (3) in contact with the locking plane of said detent transits directly on the impulse plane (5*a*, 6*a*) of the anchor arms (5, 6) without dropping.

7. Regulator according to claim 6, characterised in that the escape wheel (3) consists of only a single toothing realised on a single stage and works in the same plane P of operation as the impulse planes of the anchor (5*a*, 6*a*) and the locking planes of the detents (7*c*, 8*c*).

8. Regulator according to claim 5, characterised in that each of the two impulse planes (5*a*, 6*a*) receives one impulse from the escape wheel (3) for each period of the oscillator.

9. Regulator according to claim 5, characterised in that the impulse planes (5*a*, 6*a*) of the anchor arms have a curved shape.

10. Regulator according to claim 9, characterised in that the impulse planes (5*a*, 6*a*) of the anchor arms have a curved shape such that when the escape wheel (3) transfers its energy to the balance wheel, the escape wheel (3) moves with a uniform acceleration.

11. Regulator according to claim 1, characterised in that the regulator comprises a fixed base (9) comprising two rigid stops (10*a*, 10*b*) each respectively interacting with one of the detents (7, 8); each of these rigid stops is arranged to apply a pre-loading torque onto the respective detent.

12. Regulator according to claim 11 when it depends on any one of claims 2 to 4, characterised in that at least one of the detents (7, 8) comprises an end (8*a*) connected rigidly to an arm (13) interacting with a tuning table (11), this end (8*a*) being on the opposite end of said free end (7*a*, 8*a*) of said flexible detent (7, 8); the position of this tuning table (11) can be modified in relation to the fixed base (9) in order to change the orientation of the flexible detent (7, 8) in relation to its rigid stop (10*a*, 10*b*), thus changing the pre-loading torque of said flexible detent (7, 8) resting against the corresponding rigid stop (10*a*, 10*b*).

13. Mechanical timepiece regulator according to claim 1, characterised in that at least one of the detents (7, 8) interacts with a stiffening mechanism (14) arranged to change the active length of the leaf spring of said detent.

14. Regulator according to claim 1, characterised in that the anchor (4) comprises a tip (5*b*, 6*b*) on each of its arms (5, 6) interacting with a tooth of the escape wheel (3) in such a way that this tooth of the escape wheel (3) acts as a locking plane (3*b*) in the event that one of the detents (7, 8) does not manage to block the escape wheel (3).

15. Regulator according to claim 1, characterised in that the said elastic suspension (2*a*, 2*b*) comprises at least two leaf springs.

16. Regulator according to claim 15, characterised in that a first leaf spring (2*a*) of the said elastic suspension crosses a second leaf spring (2*b*) at the location of the centre of gravity of the balance wheel (1) and at 12.5% of the length of each leaf spring from the fixed base (9).

17. Regulator according to claim 1, characterised in that the balance wheel (1), the anchor (4) and the detents (7, 8) are made of silicon and the inertial body of the balance wheel (1*a*) is obtained by assembling a ring of dense material and a ring of silicon.

18. Timepiece movement comprising a regulator according to claim 1.

19. Wristwatch comprising a regulator according to claim 1.

* * * * *